US005431216A

United States Patent [19]

Ogushi et al.

[11] Patent Number: 5,431,216

[45] Date of Patent: Jul. 11, 1995

[54] HEAT EXCHANGE APPARATUS AND METHOD FOR PREPARING THE APPARATUS

[75] Inventors: Tetsurou Ogushi; Kunihiko Kaga; Hideharu Tanaka; Goro Yamanaka, all of Amagasaki, Japan

[73] Assignee: Mitsubishi Denki Kabushiki Kaisha, Tokyo, Japan

[21] Appl. No.: 148,333

[22] Filed: Nov. 8, 1993

Related U.S. Application Data

[60] Division of Ser. No. 579, Jan. 4, 1993, Pat. No. 5,297,623, which is a continuation of Ser. No. 741,331, Aug. 7, 1991, abandoned.

[30] Foreign Application Priority Data

Sep. 20, 1990 [JP] Japan ..... 2-252576

[51] Int. Cl.[6] ..... F28F 13/12

[52] U.S. Cl. ..... 165/122; 165/124; 165/126; 415/98; 415/102; 415/178

[58] Field of Search ..... 165/121, 122, 124, 126; 415/220, 177, 178, 98, 102; 416/184

[56] References Cited

U.S. PATENT DOCUMENTS

| | | | |
|---|---|---|---|
| 272,595 | 2/1883 | Smith | 415/220 X |
| 1,576,833 | 3/1926 | Larsen | 165/122 |
| 1,912,596 | 6/1933 | Schmidt | 165/122 |
| 3,149,666 | 9/1964 | Coe | 165/121 |
| 3,228,588 | 1/1966 | Bar | 415/98 |
| 3,285,328 | 11/1966 | Woodward | 165/121 |
| 3,953,552 | 4/1976 | Strauss | 416/184 X |
| 4,301,862 | 11/1981 | McAlister | 165/122 X |
| 4,510,991 | 4/1985 | Kawahira | 165/122 X |
| 4,513,812 | 4/1985 | Papst et al. | 165/121 X |

FOREIGN PATENT DOCUMENTS

| | | | |
|---|---|---|---|
| 413567 | 8/1910 | France | 165/122 |
| 233496 | 11/1985 | Japan | 165/86 |
| 76149 | 1/1950 | Norway | 165/122 |
| 26973 | 9/1907 | United Kingdom | 165/122 |

*Primary Examiner*—John Rivell
*Assistant Examiner*—L. R. Leo
*Attorney, Agent, or Firm*—Oblon, Spivak, McClelland, Maier & Neustadt

[57] ABSTRACT

A heat exchange apparatus comprising a heat transfer member; and at least one projecting blade which is arranged to confront the heat transfer member, and which carries out relative motion with respect to the heat transfer member; wherein a distance between the edge of the projecting at the side of the heat transfer member and a heat transfer surface of the heat transfer member is smaller than a value which corresponds to a rising point where an upward gradient of convective heat transfer coefficients rises as the distance decreases.

5 Claims, 10 Drawing Sheets

HEAT EXCHANGE APPARATUS AND METHOD FOR PREPARING THE APPARATUS

This is a division of application Ser. No. 08/000,579, filed on Jan. 4, 1993, now U.S. Pat. No. 5,297,623 which is a continuation of Ser. No. 07/741,331, filed Aug. 7, 1991 which is abandoned.

BACKGROUND OF THE INVENTION

1. Field of the Invention

The present invention relates to a heat exchange apparatus and a method for preparing the apparatus, the heat exchange apparatus carrying out heat exchange between a heated or cooled heat transfer member and e.g. air.

2. Discussion of Background

Referring to FIG. 20, there is diagrammatically shown the heat transfer form in a heat exchange apparatus which has been disclosed in e.g. Japanese Examined Utility Model Publication No. 34338/1983. In FIG. 20, reference numeral 1 designates a heat transfer member. Reference numeral 1*a* designates a heat transfer surface. Reference numeral 2 designates a fan. Reference numeral 3 designates air on the heat transfer surface 1*a*. The transfer direction of heat is indicated by arrows of solid line. The flow of air is indicated by arrows of dotted line.

The air which is driven by the fan 2 flows on and along the heat transfer surface 1*a* as indicated by the arrows of dotted line in FIG. 20, and heat in the heat transfer surface 1*a* is transferred to the air 3 due to convective heat transfer between the heat transfer surface 1*a* and the air 3.

A convective heat transfer coefficient h between the heat transfer member 1 and the air 3 which is defined by the following expression is determined by only an air flow rate and the shape of the heat transfer member 1. The structure of the conventional heat exchange apparatus described above creates a problem in that a convective heat transfer coefficient is small, and consequently a great heat transfer area is required.

$h=Q/(S\times\Delta T)$

Q: heat transfer quantity

S: heat transfer surface area of heat transfer member $\Delta T$: absolute value indicative of a temperature difference between the heat transfer surface and air In addition, the arrangement wherein the fan and the heat transfer member are arranged to be apart from each other creates another problem in that the volume of the apparatus is great.

SUMMARY OF THE INVENTION

It is an object of the present invention to solve these problems, and to provide a heat exchange apparatus capable of minimizing a heat transfer area by enhancing a convective heat transfer coefficient, capable of offering a driving force for air and capable of being fabricated in a small and lightweight manner, and to provide a method for preparing the apparatus in a simple manner.

According to a first aspect of the present invention, there is provided a heat transfer apparatus comprising a heat transfer member; and at least one disturbing projection which is arranged to confront the heat transfer member, and which carries out relative motion with respect to the heat transfer member; wherein distance between the edge of the projection at the side of the heat transfer member and a heat transfer surface of the heat transfer member is smaller than a value which corresponds to a rising point where an upward gradient of convective heat transfer coefficients rises as the distance is decreasing.

The disturbing projection may be arranged to swing.

The disturbing projection may be arranged on a disc which has a central portion formed with an aperture.

The heat transfer member may have a central portion formed with an aperture.

The disturbing projection and the heat transfer member may be arranged at a multistage manner in the direction of a driving shaft.

The heat transfer member may have a pipe arranged on a surface thereof in e.g. spiral or radial manner, a heat transport fluid passing through the pipe.

When frost is expected to be formed on the heat transfer member, distance between the projection edge at the side of the heat transfer member and the heat transfer surface of the heat transfer member may be 3 mm or less.

According to a second aspect of the present invention, there is provided a method for preparing the heat exchange apparatus comprising mounting the heat transfer member so that the projection edge at the side of the heat transfer member gets in touch with the heat transfer member; and swing the disturbing projection to cause a contacting part of the disturbing projection or the heat transfer member to wear, thereby forming a gap between the projection edge at the side of the heat transfer member and the heat transfer surface of the heat transfer member.

At least one of a heat transfer member edge at the side of the disturbing projection, and the projection edge at the side of the heat transfer member may be made of easy-to-wear material.

It has been found that where the distance between the heat transfer surface of the heat transfer member and the disturbing projection edge at the side of the heat transfer member which disturbs the flow of a fluid in the vicinity of the heat transfer member is great, a change in convective heat transfer coefficients is small and maintains a substantially constant value, and that as the distance is decreasing, the convective heat transfer coefficients are gradually rising and ultimately abruptly rise up. The point where convective heat transfer coefficients abruptly rise is called a rising point.

In the heat exchange apparatus according to the present invention, the distance between the disturbing projection and the heat transfer surface of the heat transfer member is arranged to be smaller than the value which corresponds to the rising point where the upward gradient of convective heat transfer coefficients rises, that is to say the disturbing projection is caused to carry out relative motion with respect to and in close proximity to the heat transfer member. This arrangement allows the disturbing projection to cross a thermal boundary layer on the heat transfer surface, thereby making turbulence in air flow in the vicinity of the heat transfer surface large to increase convective heat transfer coefficients, and causing air to be driven. In addition, even if frost is formed on the heat transfer surface, the frost can be scraped by the disturbing projection to prevent convective heat transfer coefficients from lowering. As a result, it is neither necessary to make the heat transfer area large nor to provide a fan, allowing the apparatus to be prepared in a small and lightweight manner. The thermal boundary layer corresponds to the thickness of a portion wherein e.g. air includes temperature variations when heat is transferred from the heat transfer surface to the air.

The disturbing projection can be swung to offer an advantage in that the air is driven from inside toward outside by a centrifugal force caused by the projection.

The disturbing projection and the heat transfer member can be arranged at the multistage manner in the direction of the driving shaft to fabricate the apparatus in the small and lightweight manner.

Even if frost has been formed on the heat transfer member, the arrangement wherein the distance between the disturbing projection and the heat transfer surface is 3 mm or less can significantly enhance increment in convective heat transfer coefficients due to a thin gap formed between the heat transfer surface and a surface of a frost layer scraped by the disturbing projection, in comparison with decrement in convective heat transfer coefficients due to a thermal resistance in the frost layer, thereby increasing total convective heat transfer coefficients.

In accordance with the method of the present invention, the gap between the disturbing projection and the heat transfer member is formed by causing the disturbing projection edge and the heat transfer member to contact each other, and swinging the disturbing projection to wear the contacting portion of the disturbing projection or the heat transfer member, which dispenses with e.g. positioning to facilitate preparation of the apparatus.

In addition, the arrangement wherein at least one of the edge of the heat transfer member at the side of the disturbing projection and the edge of the disturbing projection at the side of the heat transfer member is made of easy-to-wear material allows the gap between the disturbing projection edge and the heat transfer member to be formed easily.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
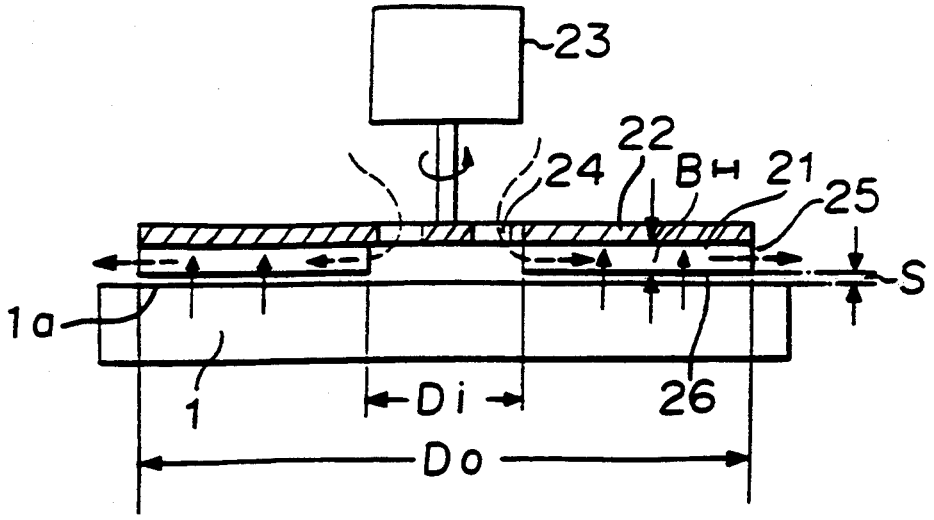
FIG. 1 is a longitudinal sectional view showing the structure of the heat exchange apparatus according to a first embodiment of the present invention.

Referring now to the drawings, wherein like reference numerals designate like or corresponding parts throughout the several views, FIG. 1 shows a longitudinal sectional diagram showing an embodiment of the heat exchange apparatus according to the present invention. In FIG. 1, reference numeral 21 designates a disturbing projection which comprises a plurality of plate-like disturbing blades. The disturbing blades are arranged on a disk 22 in a radial and vertical manner. Reference numeral 23 designates an electric motor which is to rotate the disk 22. Reference numeral 24 designates an air flow inlet, which in the embodiment is constituted by apertures which are formed in a central portion of the disk 22. Reference numeral 25 designates an air flow outlet. Reference character s designates a distance between the edge of the disturbing blades 21 at the side of a heat transfer member 1 and a heat transfer surface 1*a* of the heat transfer member 1. The distance is set to be smaller than a value which corresponds to a rising point where an upward gradient of convective heat transfer coefficients rises as the distance is decreasing. In the embodiment, the distance is as small as 0.1 mm, and is prepared by the method which will be described later on. A leading edge 26 of the disturbing blades 21 is made of a fluorine containing resin which can be easily worn, and which in the embodiment is KYNAR (trademark, manufactured by Pennwalt Corp. in the United States) (PVDF: vinylidene difluoride resin). The transfer direction of heat is indicated by arrows of solid line, the flow of air is indicated by arrows of dotted line, and the rotary direction of the disc, i.e. the disturbing blades is indicated by arrows of dual solid line.

Figure 2A:
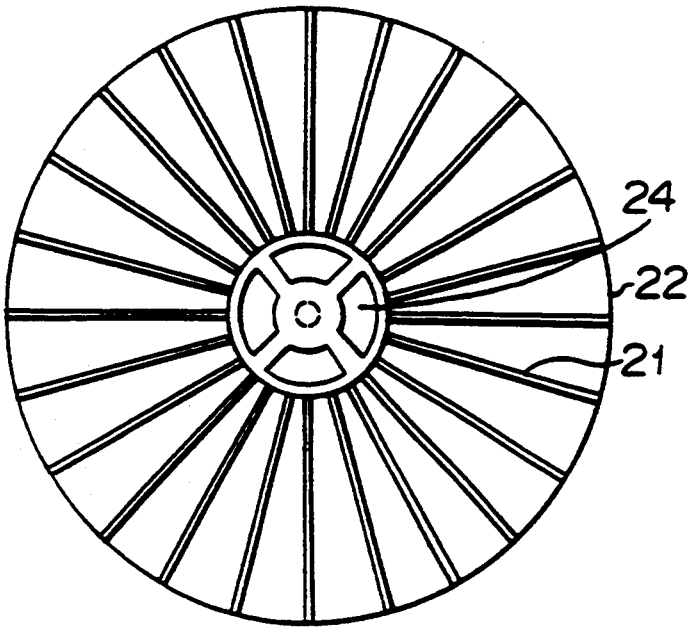
FIGS. 2(*a*) and 2(*b*) are a plane view and a side view, respectively, showing the disc with the disturbing projection arrange thereon of FIG. 1.
Figure 2B:
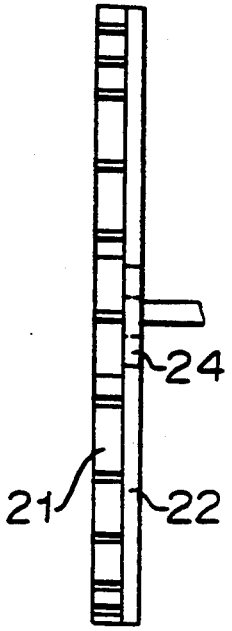

FIG. 2(*a*) is a plan view of the disk 22 with the disturbing blades 21 arranged on it as viewed from the side of the heat transfer member. FIG. 2(*b*) is a side view of the disk 22.

Firstly, the method for forming the distance s between the edge of the disturbing blades 21 and the heat transfer surface 1*a* in accordance with the present invention will be described.

Figure 3A:
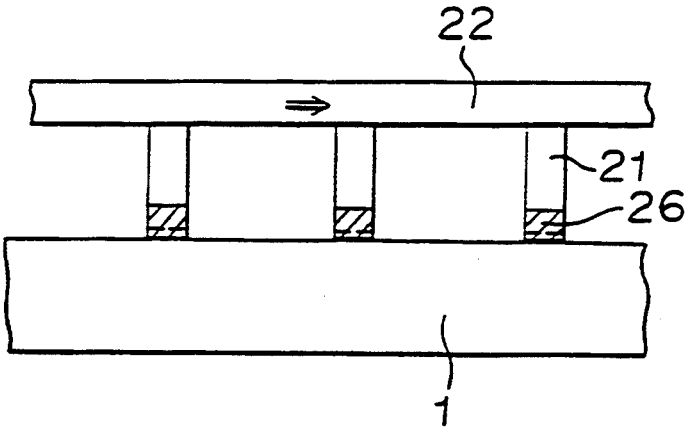
FIGS. 3(*a*) and 3(*b*) are schematic diagrams showing embodiments of the method for preparing the heat exchange apparatus according to the present invention.
Figure 3B:
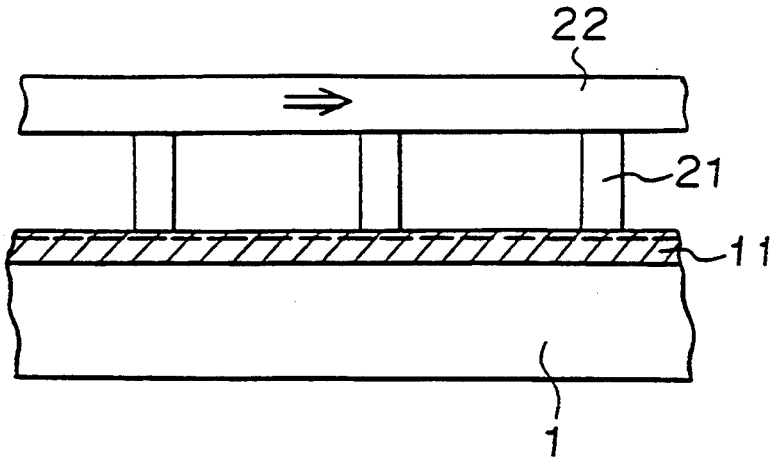

As shown in the schematic diagram of FIG. 3(*a*), the disk 22 is mounted under such state that the disturbing blades 21 are brought into contact with the heat transfer surface 1*a*, and the disk 22 is rotated to cause the disturbing blades 21 and the heat transfer surface 1*a* to rub together at their contacting portions. As a result, the leading edge 26 of the disturbing blades 21, which is made of easy-to-wear material, is worn, thereby forming the gap s between the edge of the disturbing blades 21 at the side of heat transfer member 1 and the heat transfer surface 1*a*. A heat transfer member edge 11 at the side of the disturbing blades 21 can be made of easy-to-wear material as shown in FIG. 3(*b*). Of cause, both the transfer member edge 11 and the leading edge 26 of the disturbing blades 21 may be made of easy-to-wear material.

Secondly, the operation of the heat transfer apparatus according to the embodiment will be explained. In FIG. 1, when the disturbing blades 21 on the disk 22 rotates due to rotation of the electric motor 23, the disturbing blades 21 produce centrifugal forces to drive the air, thereby causing the air to enter from the air flow inlet 24, and to flow on and along the heat transfer surface 1*a* from inside toward outside as indicated by the arrows of dotted line.

Figure 4:
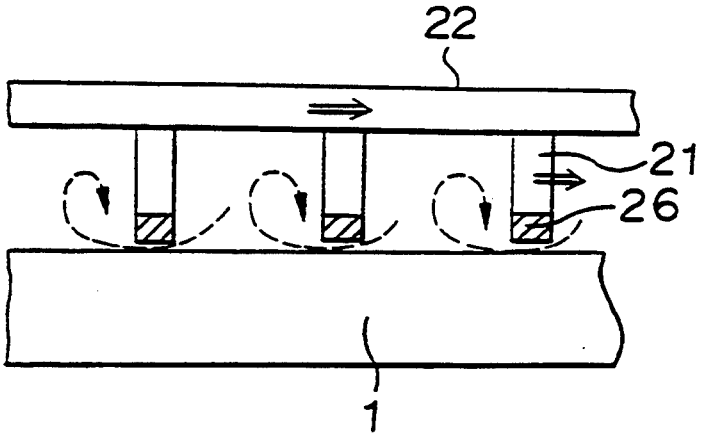
FIG. 4 is a schematic diagram showing the operation of the first embodiment of the heat exchange apparatus according to the present invention.
Figure 5:
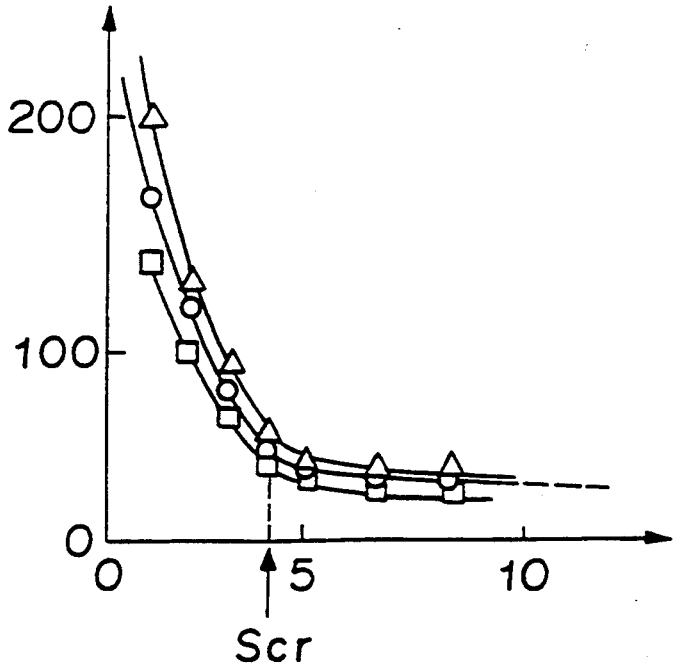
FIG. 5 is a graph showing a change in convective heat transfer coefficient relative to a distance s between the edge of the disturbing blades at the side of a heat transfer member and a heat transfer surface of the heat transfer member.

FIG. 4 is a schematic diagram showing how the air flows between the disturbing blades 21 and the heat transfer member 1. In the graph of FIG. 5, there are shown measured values on a change in convective heat transfer coefficient h relative to the distance s between the edge of the disturbing blades 21 at the side of the heat transfer member and the heat transfer surface 1*a* in the embodiment. When the distance between the edge of the disturbing blades 21 at the side of heat transfer member and the heat transfer surface 1*a* becomes smaller than the thickness of a thermal boundary layer on the heat transfer surface 1*a*, the disturbing blades 21 can cross the thermal boundary layer to remarkably enhance the convective heat transfer coefficients due to turbulence in the air flow in the vicinity of the heat transfer surface 1*a*. As shown in FIG. 5, there exists a rising point $s_{cr}$ (4 mm in the embodiment) where an upward gradient of convective heat transfer coefficients rises as the distance s between the edge of the disturbing blades 21 at the side of the heat transfer member and the heat transfer surface 1*a* is decreasing. When the distance s becomes greater, the convective heat transfer coefficients are almost unchanged and are equal to values indicative of the convective heat transfer coefficients in the conventional apparatus. In the measurement, 24 disturbing blades 21 having a height of BH=1 mm and a thickness of 2 mm are arranged on a disk 22 having a diameter $D_0$=0.4 m and an opening diameter $D_i$=0.17 m. In FIG. 5, the ordinate represents the convective heat transfer coefficients h (W/m$^2$K), and the abscissa represents the distance s (mm) between the edge of the disturbing blades at the side of the heat transfer member and the heat transfer surface. A characteristic curve of □—□ represents the characteristics of the convective heat transfer coefficients which are obtained when the disturbing blades are rotated at 500 rpm, a characteristic curve of ○—○ represents the characteristics of the convective heat transfer coefficients which are obtained when the disturbing blades are rotated at 900 rpm, and a characteristic curve of Δ—Δ represents characteristics of the convective heat transfer coefficients which are obtained when the disturbing blades are rotated at 1,200 rpm.

The arrangement of the embodiment wherein the distance between the edge of the disturbing blades 21 at the side of the heat transfer member and the heat transfer surface 1*a* is 0.1 mm which is smaller than $s_{cr}$ can enhance the turbulence in the air flow to increase the convective heat transfer coefficients of the air about 2 to 5 times those in the conventional apparatus. As a result, the area which the heat transfer surface requires is small, and a small and lightweight heat exchanger can be obtained.

Figure 6:
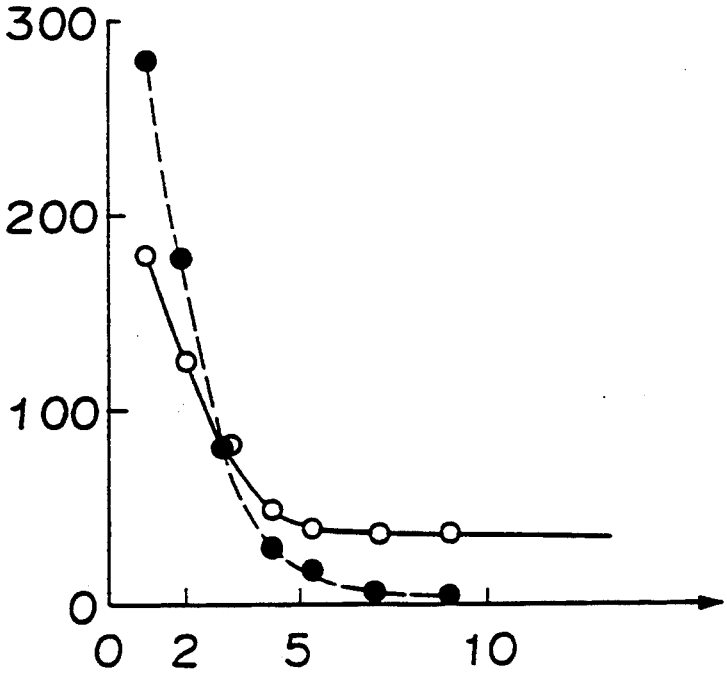
FIG. 6 is a graph showing a change in convective heat transfer coefficient relative to a distance s between the edge of the disturbing blades at the side of the heat transfer member and the heat transfer surface of the heat transfer member in a case wherein frost has been formed on the heat transfer surface, as well as in a case wherein frost has not been formed on the heat transfer surface.

In the graph of FIG. 6, there are shown measured values of changes in the convective heat transfer coefficients relative to the distance s between the edge of the disturbing blades 21 at the side of the heat transfer member and the heat transfer surface 1*a* in a case wherein the heat transfer member 1 is colder than the air and frost has been formed on the heat transfer surface 1*a* as well as a case wherein no frost has been formed on the heat transfer surface 1*a*, in the embodiment. In FIG. 6, the ordinate represents convective heat transfer coefficients h (W/m$^2$K), and the abscissa represents the distance s (mm) between the edge of the disturbing blades at the side of the heat transfer member and the heat transfer surface. A characteristic curve of solid line represents characteristics of the convective heat transfer coefficients in the absence of the frost, and a characteristic curve of dotted line represents characteristics of the convective heat transfer coefficients in the presence of the frost. It is general that when the frost has been formed on the heat transfer surface 1*a*, the convective heat transfer coefficient defined by the expression (1) is lowered due to thermal resistance of the frost layer. However, if the frost formed on the heat transfer surface 1*a* grows to have a thickness which is not less than the distance s between the edge of the disturbing blades 21 at the side of heat transfer member and the heat transfer surface 1*a* in the embodiment, the frost is scraped by the disturbing blades 21. As a result, the frost is prevented from growing beyond the distance s between the edge of the disturbing blades 21 at the side of the heat transfer member and the heat transfer surface 1*a*. Between the edge of disturbing blades 21 at the side of the heat transfer member and the surface of the frost layer is formed an extremely thin gap, which remarkably increases convective heat transfer coefficients on the surface of the frost layer. If the thickness of the frost layer is 3 mm or less, increment in the convective heat transfer coefficients due to the thin gap formed between the disturbing blades 21 and the frost layer is remarkably great in comparison with decrement due to the thermal resistance of the frost layer. As a result, as shown in FIG. 6, when the distance s between the edge of the disturbing blades 21 at the side of the heat transfer member and the heat transfer surface 1*a* is 3 mm or less, the convective heat transfer coefficients are extremely increased in the presents of the frost in comparison with the absence of the frost, which is different from the conventional apparatus. This means that when frost is formed on the heat transfer surface 1*a*, the area which the heat transfer surface requires is small, thereby allowing a heat exchanger to be obtained in a smaller and lighter manner.

Figure 7:
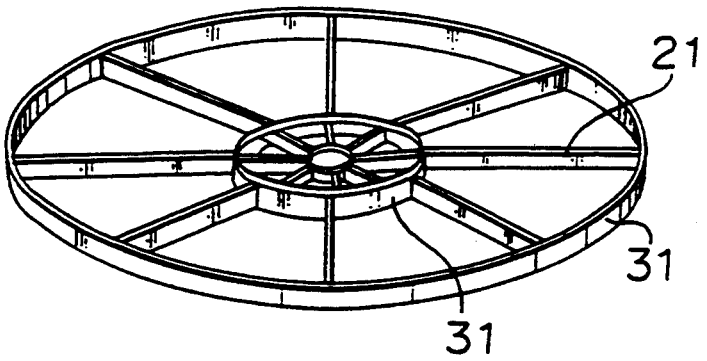
FIG. 7 is a perspective view showing the structure another embodiment of the disturbing blades according to the present invention.
Figure 8:
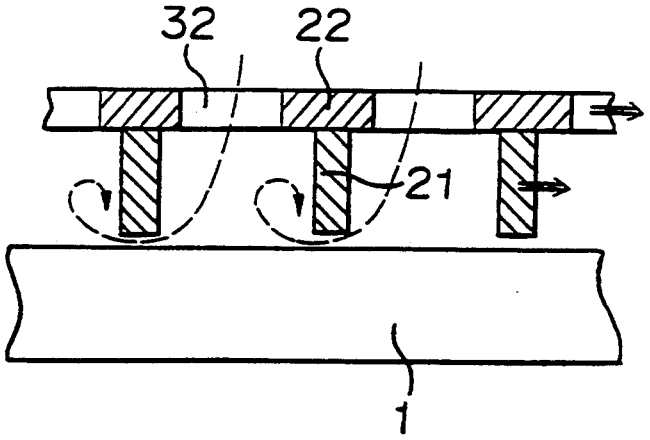
FIG. 8 is a schematic sectional diagram showing another embodiment of the shape of the disc according the present invention.

Although explanation on the embodiments as stated earlier have been made for the case wherein the disturbing blades 21 are arranged on the disk 22, the present invention is applicable to a case wherein only the disturbing blades 21 which are not arranged on the disk 22 but are fixed by supports 31 are rotated above the heat transfer surface 1*a* as shown in the perspective view of FIG. 7 as another embodiment of the disturbing blades, or a case wherein the disk 22 with the disturbing blades 21 arranged on it has apertures formed therein as shown in the schematic sectional diagram of the essential parts of FIG. 8 as another embodiment, these embodiments being capable of offering similar effects to the first embodiment. The arrangement of these modified embodiments allows the rotary portion to be lightweight, thereby offering an advantage in that the power which the rotation requires is small.

Figure 9:
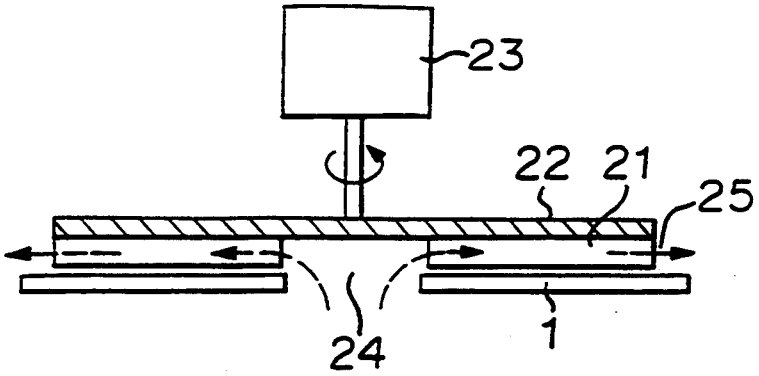
FIG. 9 is a longitudinal sectional diagram showing another embodiment of the present invention.

Although explanation on the first embodiment has been made for the case wherein the disk 22 has the central portion opened to form the air flow inlet 24, the present invention is also applicable to a case wherein the disk 22 has no opening but the heat transfer surface 1*a* has its central portion opened to form the air flow inlet 24 as shown in the longitudinal sectional diagram of FIG. 9 as another embodiment, or a case wherein the central portion of the disk 22 and the central portion of the heat transfer surface 1*a* are opened to form the air flow inlet 24, which are capable of offering advantages similar to the first embodiment.

Figure 10:
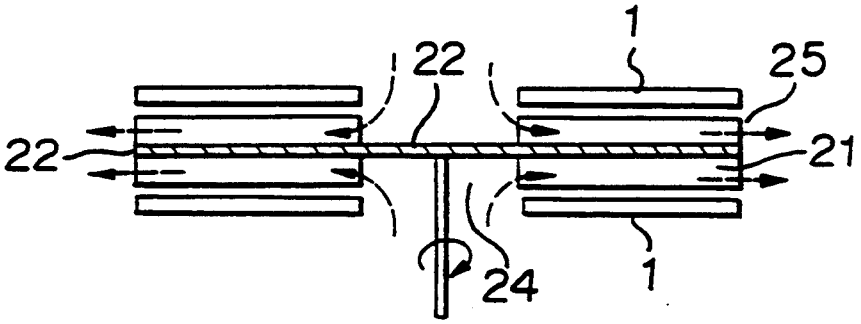
FIG. 10 is a longitudinal sectional diagram showing another embodiment of the present invention.

Although explanation on the first embodiment has been made for the case wherein the one heat transfer surface 1*a* and a row of the disturbing blades 21 confronting the heat transfer surface 1*a* are used, the present invention is also applicable to a case wherein the plural heat transfer member 1 and the plural rows of the disturbing blades 21 are arranged at a multistage manner in the direction of the driving shaft as shown in the longitudinal cross sectional diagram of FIG. 10 as another embodiment, which is capable of offering more excellent advantages. Various kinds of patterns can be adopted to arrange the heat transfer members 1 and the disturbing blades 21 at a desired multistage manner.

As illustrated in FIG. 10, the blades 21 extend from opposite sides of the disk 22. Heat transfer members 1 are positioned on opposite sides of the disk 22 such that each of the blades 21 which extend from opposite sides of the disk 22 face a respective heat transfer member 1. Also, a blade 21 and a heat transfer member 1 define an opening 24 on one side of the disk 22 which is coaxial with an opening defined on the opposite side of the disk by the opposite heat transfer member 1 and blade 21.

Figure 11:
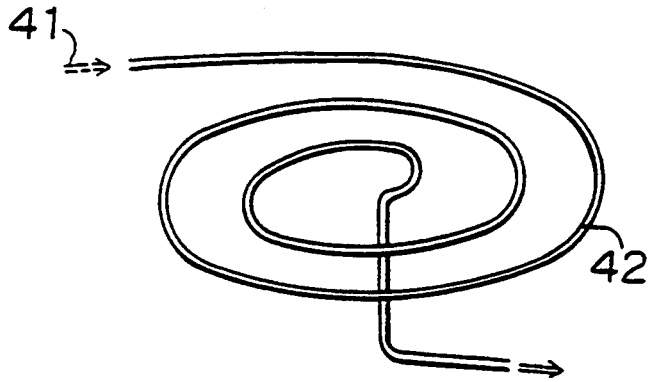
FIGS. 11 and 12 are a perspective view and a plan view, respectively, showing other embodiments of the heat transfer member according to the present invention.
Figure 12:
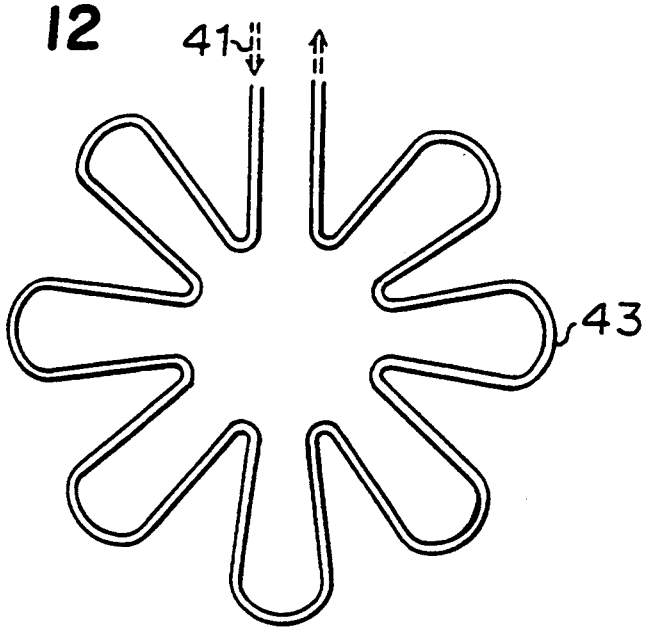
Figure 13:
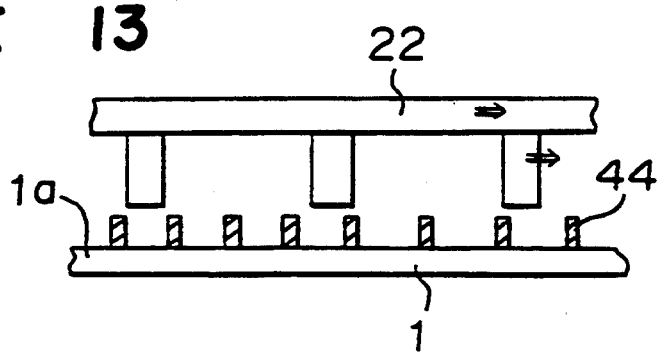
FIG. 13 is a schematic diagram sectional diagram showing another embodiment of the structure of the heat transfer member according to the present invention.
Figure 14A:
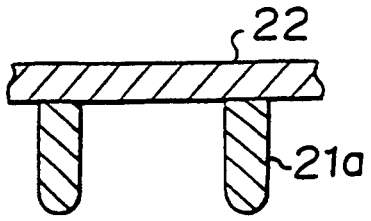
FIGS. 14(*a*)–14(*e*) are schematic sectional diagrams showing embodiments of the disturbing blades according to the present invention.
Figure 14B:
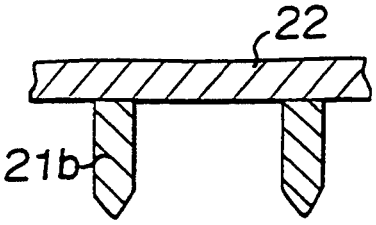
Figure 14C:
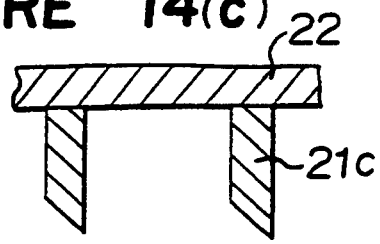
Figure 14D:
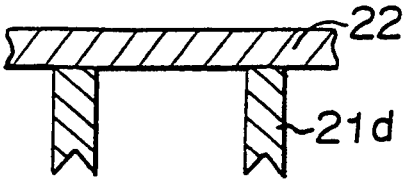
Figure 14E:
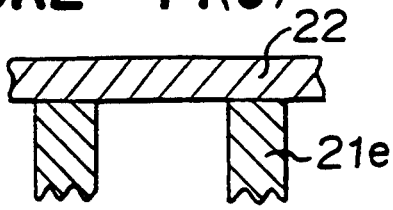

Although explanation on the first embodiment has been made for the case wherein the heat transfer member 1 comprises a piece of metallic plate, the present invention is also applicable to a case wherein a spiral pipe 42 through which a heat transport fluid 41 flows is arranged in a spiral manner on a plane to form the heat transfer member as shown in the perspective view of FIG. 11 as another embodiment of the heat transfer member, or a case wherein a radial pipe 43 through which the heat transport fluid 41 flows is arranged in a radial manner on a plane to form the heat transfer member as shown in the perspective view of FIG. 12 as another embodiment of the heat transfer member. The present invention is also applicable to a case wherein the heat transfer surface 1*a* which is constituted by a metallic plate has fins 44 arranged on it to form irregularity on it. The presence of such irregularity gives a corrugated shape or a rugged shape to the heat transfer surface to enhance the turbulence of the air flow, thereby offering an advantage in that the convective heat transfer coefficients can be remarkably increased.

Although explanation on the embodiments has been made for the case wherein the disturbing blades 21 have a rectangular cross section, various kinds of cross sectional shapes such as a circular cross section 21*a*, a triangular cross section 21*b*, a serrate cross section 21*c*, an M-letter cross section 21*d* and a corrugated cross section 21*e* as shown in the schematic cross sectional views of FIGS. 14(*a*)–14(*e*) as other examples of the cross sectional shape of the disturbing blades can be adopted, which are capable of offering similar advantages. In particular, the M-letter cross section 21*d* and the corrugated cross section 21*e* can promote the turbulence of the air flow to offer an advantage in that the convective heat transfer coefficients can be further increased.

Figure 15:
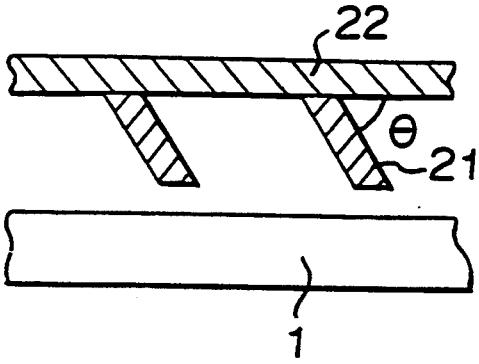
FIG. 15 is a schematic sectional diagram showing how the disturbing blades are arranged on the disc in accordance with an embodiment of the present invention.

Although explanation on the embodiments has been made for the case wherein the disturbing blades 21 are vertically arranged on the disk 22, the present invention is applicable to a case wherein the disturbing blades 21 are arranged on the disk 22 to be inclined at an angel Θ to the disk 22 as shown in the schematic cross sectional diagram of FIG. 15, which can offer similar advantages.

Figure 16:
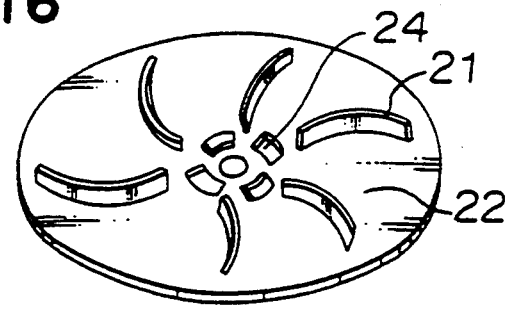
FIG. 16 is a perspective view showing another embodiment of the disturbing blades of the present invention.

Although explanation on the embodiments has been made for the case wherein the disturbing blades 21 are arranged in a liner manner on the disk 22 in radial directions, the disturbing blades 21 have not necessarily to be linear. For example, disturbing blades 21 which are curved in the circumferential direction as shown in the perspective view of FIG. 16 can be used to offer similar advantage.

Figure 17:
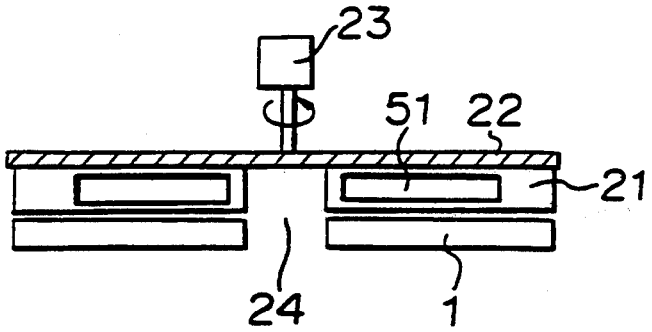
FIG. 17 is a longitudinal sectional diagram showing a modified embodiment of the disturbing blades of the present invention.
Figure 18:
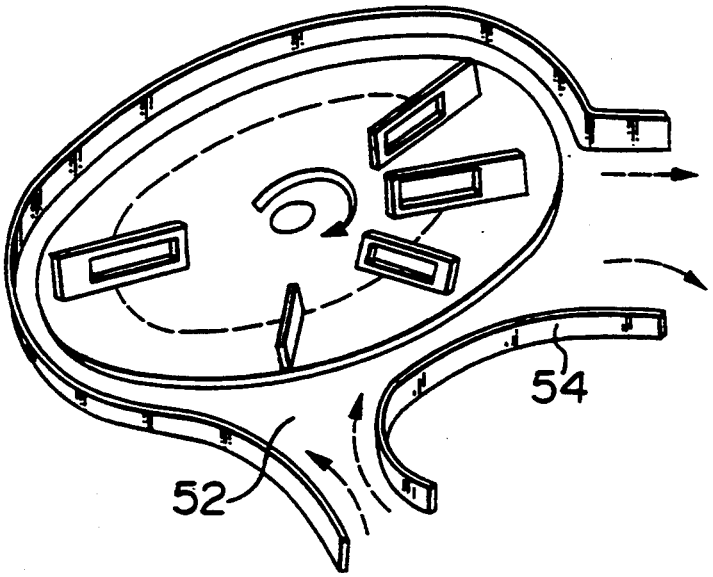
FIG. 18 is a perspective view showing another embodiment of the structure of the disturbing blades of the present invention.

Although explanation on the embodiments has been made for the case wherein the disturbing blades 21 are radially and linearly arranged on the disk 22 to extend from the air flow inlet 24 to the air flow outlet 25, the present invention is also applicable to a case wherein the disturbing blades 21 are arranged on a portion of the disk 22 in its radial directions. The present invention is also applicable to a case wherein the disturbing blades 21 have a portion formed with an aperture 51 as shown in the longitudinal cross sectional view of FIG. 17. Such arrangements causes the rotary portion to be lightweight, thereby offering an advantage in that the power which the rotation requires is small. In addition, a casing 54 which has an air flow inlet 52 and an air flow outlet 53 can be provided to cover around the rotary disk 22 with the disturbing blades 21 arranged on it as shown in the perspective view of a disturbing blade providing portion of FIG. 18. Such arrangement allows air to enter and flow out on the same plane as the disk 22, thereby offering an advantage in that the apparatus according to the present invention can be utilized even if a limited space in the direction of the rotary shaft prevents provision of the inlet and outlet for the air flow.

Figure 19:
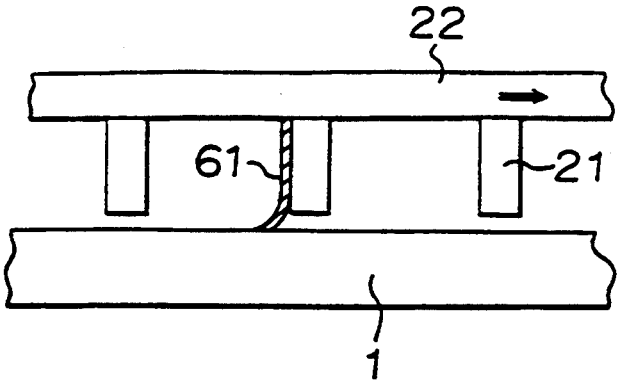
FIG. 19 is a schematic sectional diagram showing another embodiment of the disturbing blades according to the present invention.
Figure 20:
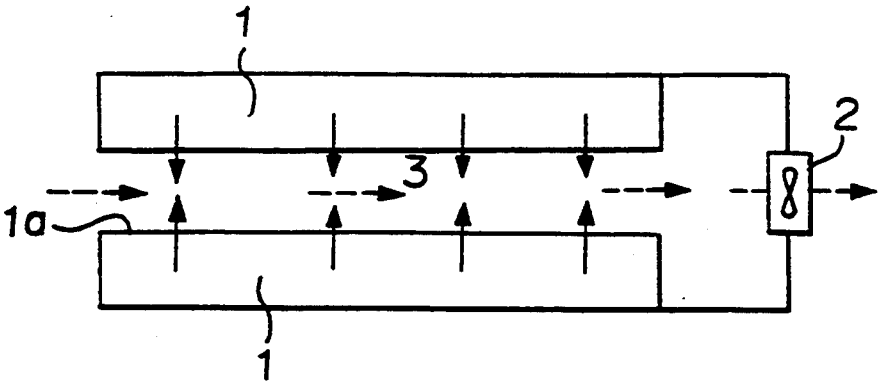
FIG. 20 is a schematic diagram showing a conventional heat exchange apparatus.

Although the disturbing blades 21 are stated as being effective to scrape the frost layer which has been formed on the heat transfer surface 1*a*, the present invention is also applicable to a case wherein the disturbing blades 21 are provided with a frost layer scraping blade 61 which is made of a rubber plate etc. as shown in the schematic diagram of FIG. 19, which can offer similar advantage.

In addition, although explanation on the embodiments stated earlier has been made for the case wherein air is used as the fluid to be utilized for convective heat transfer, other fluids can be used to offer similar advantage. Although explanation on the embodiments has been made for the case wherein the disturbing blades are rotating, the present invention is not limited to a case wherein the disturbing blades are rotating, but is applicable to e.g. a case wherein the disturbing blades are reciprocated in a swing movement at a predetermined angle, or a case wherein the heat transfer member is driven.

Obviously, numerous modifications and variations of the present invention are possible in light of the above teachings. It is therefore to be understood that within the scope of the appended claims, the invention may be practiced otherwise than as specifically described herein.

What is claimed is:

1. A heat exchanger apparatus comprising:

a rotatable disk;

first and second heat transfer members positioned on opposite sides of said rotatable disk;

at least one first blade extending from a first surface of said disk in a direction toward said first heat transfer member so as to face said first heat transfer member; and at least one second blade extending from a second surface of said disk which is opposite said first surface of said disk in a direction toward said second heat transfer member so as to face said second heat transfer member;

wherein:

said first heat transfer member has a first aperture which forms a first central air flow inlet on a first side of said disk for introducing a first air flow between said first heat transfer member and said first blade for transferring heat in the first heat transfer member to said first air flow, said first blade extending radially outwardly from an area radially outside said first central air flow inlet; and said second heat transfer member has a second aperture which forms a second central air flow inlet on a second side of said disk which is opposite said first side for introducing a second air flow between said second heat transfer member and said second blade for transferring heat in the second heat transfer member to said second air flow, said second blade extending radially outwardly from an area radially outside said second central air flow inlet.

2. A heat exchanger apparatus according to claim 1, wherein the first and second blades are arranged to swing.

3. A heat exchanger apparatus according to claim 1, wherein said first and second air flow inlets are coaxial.

4. A heat exchanger apparatus according to claim 1, further comprising:

means for rotating said disk with said first and second blades positioned thereon relative to said first and second heat transfer members to cause said first and second air flows to respectively flow radially outwardly along said first and second blades.

5. A heat exchanger apparatus according to claim 1, wherein a distance defined respectively between an edge of each of said first and second blades and an opposing heat transfer surface of each of said first and second heat transfer members is smaller than a value which corresponds to a rising point where an upward gradient of convective heat transfer coefficient rises as the distance decreases.

* * * * *